US008714346B2

(12) United States Patent
Freitag

(10) Patent No.: US 8,714,346 B2
(45) Date of Patent: May 6, 2014

(54) CONVEYOR BELT FOR A TREADMILL

(75) Inventor: Jens Freitag, Kassel (DE)

(73) Assignees: TEO Industriedesign GmbH, Kassel (DE); Hübner GmbH & Co. KG, Kassel (DE)

( * ) Notice: Subject to any disclaimer, the term of this patent is extended or adjusted under 35 U.S.C. 154(b) by 648 days.

(21) Appl. No.: 12/972,952

(22) Filed: Dec. 20, 2010

(65) Prior Publication Data

US 2011/0152038 A1 Jun. 23, 2011

(30) Foreign Application Priority Data

Dec. 21, 2009 (DE) ..... 20 2009 017 334 U

(51) Int. Cl.
*A63B 22/02* (2006.01)

(52) U.S. Cl.
USPC ..... 198/847

(58) Field of Classification Search
USPC ..... 198/847; 428/141; 474/260, 268
See application file for complete search history.

(56) References Cited

U.S. PATENT DOCUMENTS

| | | | | | |
|---|---|---|---|---|---|
| 1,211,765 | A * | 1/1917 | Schmidt | 482/54 |
| 2,820,454 | A | 1/1958 | Wright | |
| 2,842,365 | A * | 7/1958 | Kelley | 482/51 |
| 3,711,090 | A * | 1/1973 | Fiedler | 482/54 |
| 4,204,673 | A * | 5/1980 | Speer, Sr. | 482/5 |
| 4,509,510 | A * | 4/1985 | Hook | 601/28 |
| 4,603,851 | A * | 8/1986 | Russell | 482/79 |
| 5,108,094 | A | 4/1992 | Quinn et al. | |
| 5,383,828 | A * | 1/1995 | Sands et al. | 482/54 |
| 5,470,293 | A * | 11/1995 | Schonenberger | 482/54 |
| 5,951,441 | A * | 9/1999 | Dalebout et al. | 482/54 |
| 6,071,354 | A * | 6/2000 | Williams | 134/6 |
| 6,152,854 | A * | 11/2000 | Carmein | 482/4 |
| 6,180,210 | B1 * | 1/2001 | Debus | 428/167 |
| 6,455,123 | B1 * | 9/2002 | Poe, Sr. | 428/102 |
| 8,002,674 | B2 * | 8/2011 | Piaget et al. | 482/52 |
| 8,033,387 | B2 * | 10/2011 | Wang | 198/847 |
| 8,162,769 | B2 * | 4/2012 | Henry | 472/128 |
| 8,206,801 | B2 * | 6/2012 | Chang | 428/56 |
| 8,308,592 | B2 * | 11/2012 | Radding et al. | 474/237 |
| 8,439,807 | B2 * | 5/2013 | Piaget et al. | 482/52 |
| 2004/0082890 | A1 * | 4/2004 | Kuo | |

FOREIGN PATENT DOCUMENTS

| | | | |
|---|---|---|---|
| DE | 1913216 | A1 | 10/1970 |
| DE | 3511302 | A1 | 10/1986 |
| DE | 3902018 | A1 | 7/1990 |
| DE | 9006933 | U1 | 8/1990 |
| DE | 29916850 | U1 | 12/1999 |
| EP | 1743989 | A1 | 1/2007 |

* cited by examiner

*Primary Examiner* — Douglas Hess
(74) *Attorney, Agent, or Firm* — Gifford, Krass, Sprinkle, Anderson & Citkowski, P.C.

(57) ABSTRACT

A conveyor belt for a treadmill has a contoured structure on its upper surface which causes a runner to experience bumps and depressions when running. The contoured features may be provided by plates attached to the conveyor belt, and/or by inserts placed onto the belt or within chambers defined in the belt. The contoured features may vary in hardness.

7 Claims, 3 Drawing Sheets

CONVEYOR BELT FOR A TREADMILL

CROSS-REFERENCE TO RELATED APPLICATIONS

This application claims priority of German Patent Application DE 20 2009 017 334.8 filed Dec. 21, 2009, which is incorporated herein by reference.

FIELD OF THE INVENTION

The invention concerns a conveyor belt for a treadmill.

BACKGROUND OF THE INVENTION

Treadmills are exercise machines having a conveyor belt running over two rollers arranged at a distance from one another. The speed of the conveyor belt can be adjusted. Treadmills of this type are used to achieve, or respectively, maintain physical fitness.

The known conveyor belts for treadmills have two belts separated from one another, whereby the belts encircle two rollers which are arranged at a distance from one another. The two belts which are separated from one another accommodate numerous plates which are arranged consecutively in such a manner that they basically form a closed running surface. The plates which are, for example, glued or riveted to the belts are approximately 1 ½ to 2 cm thick and made of an elastomer.

In addition, there are treadmills made of endless belts having a foundation layer made of a textile, wherein said textile is coated with a plastic material.

The exercise period for runners on treadmills can run from a few minutes to over an hour or more, i.e. during said period, the running surface is run upon continuously. The exercise on a treadmill of this sort should serve in the function of maintaining fitness, and should ultimately replace running outdoors. When running outdoors, off of established paths, the musculature must constantly adjust for different surface structures. This means that when running, e.g. in a forest, due to the unevenness of the ground the muscles in the lower leg are exercised in a manner that they would not be, or would hardly be, otherwise engaged. This means that in exercising on a treadmill different muscles, simply due to the fact that one is running on an even surface, are not at all, or barely, engaged. This concerns particularly the musculature which compensates for a misalignment of the foot. Exercise of this type on an even surface leaves however, not only different muscle groups to atrophy or unengaged, but also leads in the end to atrophy of the tendons in the foot region, as these too are in no manner engaged as would otherwise be the case if the runner were on an uneven surface.

The basic objective of the invention accordingly is to provide a conveyor belt for a treadmill which recreates the experience of running on an uneven surface.

To obtain the objective it is proposed in accordance with the invention that the conveyor belt have on its upper surface, i.e. on the running surface, a contoured type structure such that the runners experience bumps and depressions when running on it. From this it is clear that the musculature and the tendons of the lower leg are engaged when running in proportion to the heights of the bumps and depressions on the upper surface of the conveyor belt.

A conveyor belt of this type serves however not only in the role of maintaining fitness for healthy runners, but also has quite definite therapeutic aspects. In this respect it should be noted that patients suffering from Parkinson's disease not only display an exaggerated trembling of the limbs, but also suffer from a lack of coordination in their movements and also suffer impairment to their sense of balance. In particular, due to the impairment of their coordination, and also the impairment of their sense of balance, many patients suffering from Parkinson's disease, particularly in advanced stages of the disease, suffer a lack of confidence regarding running. Due to the lack of motion, the musculature of the entire body also atrophies, particularly the musculature of the lower leg as well. In order to promote motor functions of patients suffering from Parkinson's disease, getting them to walk using aids, such as railings or the familiar walkers, is already known. It has been shown however that the confidence of such patients suffering from Parkinson's disease is not sufficient, even for exercises with walkers or with railings, to get them to the point where they can run by themselves without such aids. This is explained for the most part in that practically every surface has a certain unevenness, which poses a danger to the Parkinson patient of losing one's balance when walking on such surfaces, i.e. placing one foot in front of the other.

As stated previously, due to the lack of exercise with these patients, the body musculature necessary for them to be able to move around independently is underdeveloped. For this, not only the primary leg musculature, including the lower leg musculature, but also the overall musculature of the body which is necessary for stabilizing the body when walking, is involved.

In this context, the availability of plates which one may walk on having a contoured surface is already known. It has been shown that patients suffering from Parkinson's disease, who walk on plates of this type, having a contoured surface structure, obtain a certain confidence in walking. By means of a contoured structure, having bumps and depressions, which may, depending on the conditions, display a difference in height of several centimeters, visual stimulation is also experienced by patients walking on said, the processing of which forces them to think about how they should approach an uneven surface of this kind. In particular, the combination of visual stimuli and appropriately corresponding physical stimuli promotes the motor functions and proprioceptive perception in not only patients suffering from Parkinson's disease, but also with normal, healthy people.

A further disadvantage of plates which may be walked on of this sort, even when a large number of them are distributed in a space, is that the patient adjusts to the contoured structure on a visual level. The possibility of adjusting to a certain repeating contoured structure is not present however when the patient is outdoors. There, the surface is always different. This means that the motor functions of the patient should not be controlled solely by means of visual stimuli, but rather, the patient should learn to adjust for changing surfaces independently of said.

SUMMARY OF THE INVENTION

Through exercise on a treadmill in which the conveyor belt has a contoured surface structure, a patient of this sort, suffering from Parkinson's disease, or other people who have difficulties with their motor functions, can be placed in a situation where he is no longer able to adjust visually to the surface of the conveyor belt. This is because the conveyor belt is moving continuously, and due to the length of the conveyor belt it is possible to structure the contours such that they do not repeat over the course of the entire conveyor belt. This means that the patient walking on a conveyor belt of this type is unable to visually adjust to the surface.

Advantageous characteristics and embodiments of the invention can be derived from the dependent claims. According to one embodiment of the conveyor belt, the conveyor belt has at least two belts spaced apart from each other whereby individual plates are arranged on the belts which have contoured structures on their upper surfaces. The advantage of using individual plates with contoured structures is that the height of the plates in relation the diameter of the rollers of the treadmill may be relatively large. For this, plates of heights between 25 and 50 mm may be used. This means that because of the large thickness of such plates a pronounced contoured structure may be created. Furthermore, there is the possibility of structuring the plates such that they have differing degrees of hardness on their surface areas, for example, in that the plates have chambers on their lower surfaces in which inserts can be placed. For this, the insert may be made of a soft plastic which deviates from the material of the rest of the plate in terms of hardness. It is conceivable in this context to inject the inserts with the material of the individual plates having the contoured surface structure, for example, with so-called two-component injection molding methods.

The actual belts which serve to support the individual plates having a contoured surface structure have at least one textile layer as a supporting layer. The attachment of the plates to the belts is obtained, for example, through riveting or with glue.

According to another embodiment it is intended that the conveyor belt have at least two encircling belts spaced apart from each other which are attached to an endless mat having a contoured surface structure which also runs around the entire circumference. A mat of this type made of elastic, flexible material, e.g. PU foam, and having an average height of approx. 10-25 mm, can be guided, having the appropriate elasticity, together with the belts which transport the mat, around the rollers of the treadmill. With a height of between 10-25 mm it is also possible for the contoured surface structure to be noticeable even when running with shoes.

According to another, third embodiment it is intended that the conveyor belt have a support layer made of textile whereby the support layer has a running surface with a contoured surface structure made of an elastic material, e.g. PU foam. Here too the support surface may have a thickness of between 10 and 25 mm, whereby this embodiment is distinguished from the previously described embodiments in that it exhibits an increased stability because the support layer extends over the entire width of the conveyor belt, as is already known from the prior art in regard to the support layer.

Basically it is the case that different degrees of hardness are intended in the mat or in the running layer with the contoured structured areas. This can be accomplished in the manner described in respect to the conveyor belt with plates.

BRIEF DESCRIPTION OF THE DRAWINGS

Based on the illustrations, the invention will be explained in the following in greater detail using examples.

DETAILED DESCRIPTION OF THE INVENTION

Figure 1:
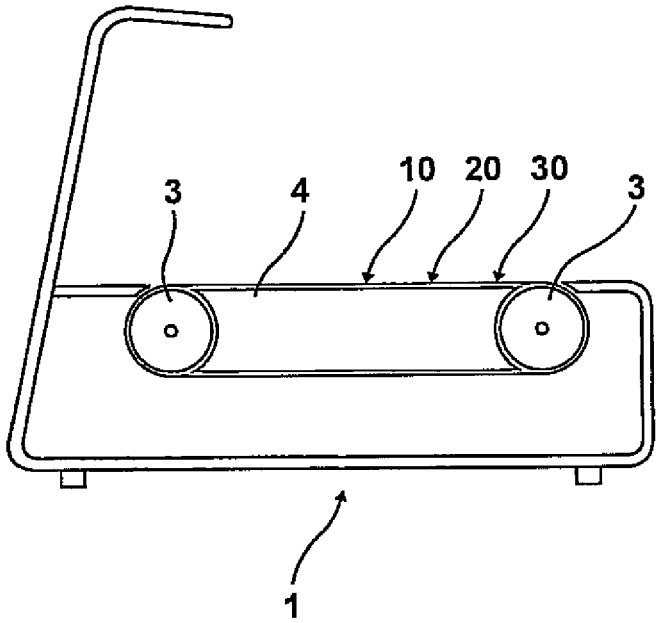
FIG. 1 shows a schematic view of a treadmill.

The treadmill according to FIG. 1, indicated by the numeral 1 has the two rollers 3 around which the conveyor belt, indicated by the numeral 10, runs. Between the two rollers 3 is a platform 4, on which the conveyor belt is supported when weighted by a runner.

The object of the invention is the construction of the conveyor belt.

Figure 2:
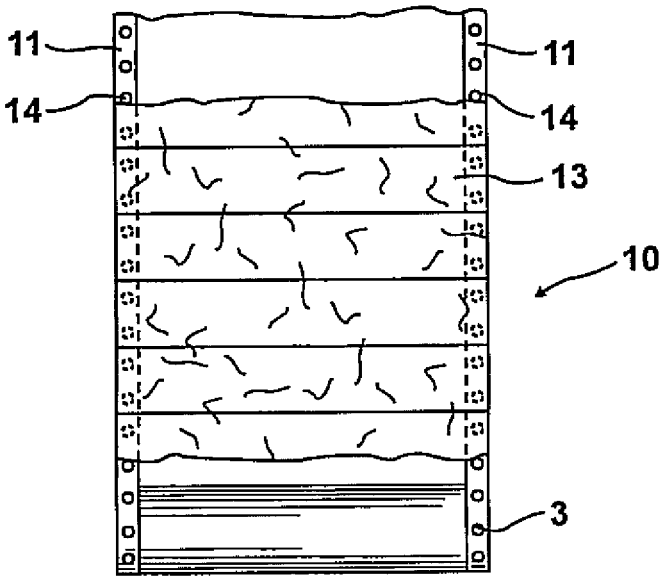
FIG. 2 shows a first embodiment of a conveyor belt with two separate belts which support individual plates.

According to the embodiment in accordance with FIG. 2, the conveyor belt, indicated by the numeral 10 consists of two separate belts 11 which run over the rollers 3, whereby the individual plates 13 are located on the belts 11. The attachment of the plates 13 to the belts is made with, for example, rivets 14.

Figure 5:
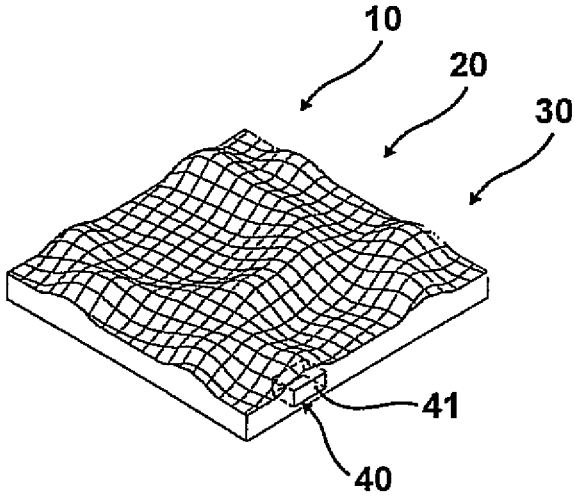
FIG. 5 shows an example of a contoured surface structure, such as that used for all three embodiments.

The plates 13 have a contoured surface structure which is clearly apparent in the illustration of FIG. 5. It is important that for the construction of the contoured surface structure, said contoured surface structure continues in a like manner from one plate to the next. This means that the surface structure, i.e. the contour is continuous over the entire length and width of the conveyor belt formed by the individual plates. In this manner, there are no abrupt edges; more importantly, it is the case that the conveyor belt displays a unified entity over its entire length in terms of the contoured surface structure.

Figure 3:
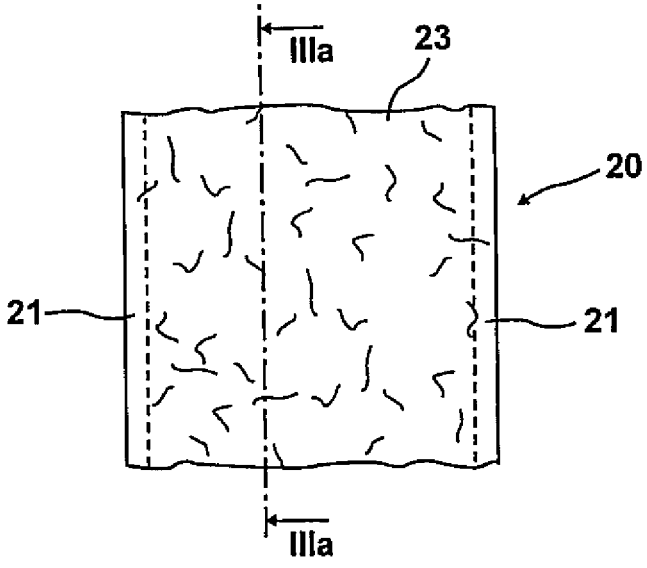
FIG. 3 shows another, second embodiment which also has two separate belts whereby an encompassing mat is supported by the belts.
Figure 3A:
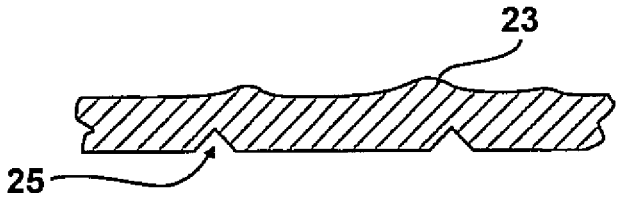
FIG. 3*a* shows a detail of FIG. 3.

With the embodiment according to FIG. 3, the conveyor belt as a whole is indicated by the numeral 20. In this case there are also two separate belts 21, whereby the belts 21 support the encompassing endless mat, indicated by the numeral 23. The mat 23, which is made of an elastomer, e.g. a soft polyurethane foam, is attached to the belts 21 with, for example, glue or rivets. It is also the case here that the contoured surface structure is continuous over the entire length of the mat 23. This also means that, where the two ends of the mat are connected in order to create the endless belt, there are no abrupt edges. This eliminates the danger of stumbling.

Figure 4:
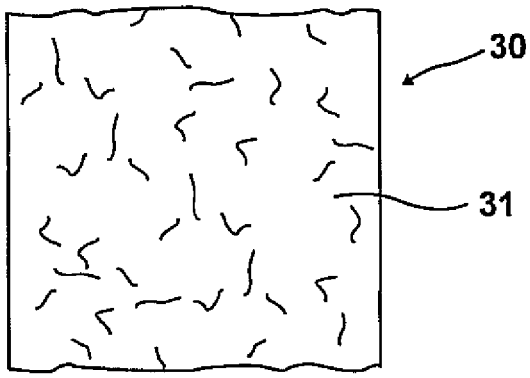
FIG. 4 shows another, third embodiment with which, for example, a woven textile is implemented having a contoured surface structure formed by an elastic material.

FIG. 4 shows the third embodiment of a conveyor belt, the structure of which comprises a conveyor belt, indicated here with the numeral 30, made of a woven textile which basically extends over the entire width of the conveyor belt. On the upper surface of the conveyor belt 30 there is in turn a contoured structure, which is created through the application of an appropriate plastic layer 31. Here too, the surface structure is continuous over the entire length of the conveyor belt.

The heights of the contoured running layer may be different in each of the three embodiments. Due to the fact that in the embodiment according to FIG. 2 the plates are arranged individually on the two parallel separate belts, the possibility exists in this case for the selection of a greater plate thickness, which results in the possibility of making the depressions and bumps of the contoured surface structure more pronounced. The reason for this is that as the belt, together with the plates, bends around the rollers 3, due to the narrowness of the plates, there is no difficulty to be expected as they pass around the rollers. It is conceivable, in this regard, that the plates have an average thickness of 25-50 mm.

In the embodiment of the conveyor belt according to FIGS. 3 and 4 however, it should be noted that depending on the thickness of the running surface, including the thickness of the mat, or respectively, the thickness of the PU layer sprayed onto the woven textile layer, with greater thicknesses, either the diameter of the rollers 3 must be increased or the thickness of the layer must be reduced. Likewise, there is the possibility with the structure according to FIG. 3 for the mat 23 to have slits or grooves running crosswise to the moving direction of the mat on the lower surface of said, in order to improve the bending properties of the mat as it runs over the rollers. As already stated, slits or grooves of this type are only to be found on the lower surface of the mat and not on the upper surface in order that for the runner the surface exhibits an unbroken structure. For these two embodiments, average thicknesses of 10-25 mm are conceivable.

The plates 13 and the mat 23 as well as the conveyor belt 30 with the respective contoured surface structure exhibit yet another characteristic of the invention, namely one or more chambers 40 which can accommodate inserts 41 in order to create regions with a different hardness on the conveyor belt. The inserts are of a material having a hardness which is different to that of the rest of the material surrounding the chambers. It is also conceivable to leave the chambers 40 empty in order to create regions with a different hardness.

The invention claimed is:

1. A conveyor belt for a treadmill, wherein the conveyor belt has a pronounced contoured structure on its upper surface such that a runner who is using the treadmill experiences bumps and depressions, the pronounced contoured structure on the upper surface being continuous along a length of the conveyor belt such that there are no abrupt edges; and wherein the conveyor belt comprises two separate generally parallel rotating belts having individual plates affixed to the belts, said plates each extending between the generally parallel belts, said plates each having a contoured structure on their upper surfaces, the contoured structure on the upper surface of each plate being continuous with the adjacent plates such that there are no abrupt edges.

2. The conveyor belt according to claim 1, wherein the width of the plates is a function of the diameter of the rollers of the treadmill.

3. The conveyor belt according to claim 2, wherein the plates have an average height of between 20 and 50 mm.

4. The conveyor belt according to claim 1, wherein the plates have chambers on their lower surfaces.

5. The conveyor belt according to claim 4, wherein the chambers are configured to receive inserts therein.

6. The conveyor belt according claim 1, wherein at least one of the plates includes at least one insert having a hardness which is different from the hardness of the material from which the rest of the plate is made.

7. The conveyor belt according to claim 6, wherein the insert is molded into the material of the plate.

* * * * *